United States Patent [19]

DelGuidice et al.

[11] Patent Number: 5,004,430

[45] Date of Patent: Apr. 2, 1991

[54] PANEL MOUNT ELECTRICAL CONNECTOR

[75] Inventors: Henry L. DelGuidice, Winston-Salem; Edward K. Marsh, Kernersville, both of N.C.

[73] Assignee: AMP Incorporated, Harrisburg, Pa.

[21] Appl. No.: 932,073

[22] Filed: Nov. 17, 1986

[51] Int. Cl.[5] ..... H01R 13/627

[52] U.S. Cl. ..... 439/350; 439/357; 439/552; 439/629

[58] Field of Search ..... 439/62, 347, 350, 351, 439/357, 544–547, 549, 550, 552, 553, 555, 557, 562, 563, 569, 571, 572, 629

[56] References Cited

U.S. PATENT DOCUMENTS

| | | | |
|---|---|---|---|
| 2,756,403 | 7/1956 | Francis et al. | 439/552 |
| 3,651,446 | 3/1972 | Sadogierski et al. | 439/552 |
| 3,760,335 | 9/1973 | Roberts | 439/493 |
| 3,820,053 | 6/1974 | Champion et al. | 439/544 |
| 4,042,289 | 8/1977 | Heinonen et al. | 439/629 |
| 4,050,769 | 9/1977 | Ammon | 439/629 |
| 4,054,345 | 10/1977 | Sherwood | 439/629 |
| 4,179,179 | 12/1979 | Lowden | 439/550 |
| 4,225,209 | 9/1980 | Hughes | 439/350 |
| 4,235,502 | 11/1980 | Marks et al. | 439/557 |
| 4,257,028 | 3/1981 | Narozny et al. | 439/552 |
| 4,469,387 | 9/1984 | McHugh | 339/17 LC |

FOREIGN PATENT DOCUMENTS

| | | | |
|---|---|---|---|
| 2254382 | 5/1973 | Fed. Rep. of Germany | 439/557 |
| 1117724 | 11/1969 | United Kingdom | 439/357 |

OTHER PUBLICATIONS

Champ Connector Systems; AMP Catalog 73-152 (Rev. 3-84), pp. 56-60.

*Primary Examiner*—P. Bradley
*Attorney, Agent, or Firm*—Eric J. Groen

[57] ABSTRACT

An electrical connector which has a plurality of electrical contacts for interconnecting a plurality of data or communication lines is panel mountable. The connector includes a front mating portion which is insertable from outside of the panel and latchably attaches to the panel. The housing portion which includes the contacts is insertable from the rear of the panel and latches to the front mating portion.

16 Claims, 5 Drawing Sheets

198a
196a
194a
200a
192a
202a
188a

BEND
182a
186a
184a
78
73
74
80
82
79
76
76
73
92
108
92
106
94
102
84
98
82
88
96
108
90
84
86
78
73
104
100
72

156
154
158
152
150

PANEL MOUNT ELECTRICAL CONNECTOR

BACKGROUND OF THE INVENTION

1. Field of the Invention

The subject invention relates to an electrical connector for interconnecting a plurality of electrical signals, the electrical connector being panel mountable and profiled for interconnection to a matable connector.

2. Description of the Prior Art

There exists within the data communications industry an application using printed circuit board mounted electrical connectors for transferring information into and out of a computer, the term used in the art for the connection being generally referred to as an I/O connection. Typically at the interface of the computer, there exists an electrical connector which will interconnect the internals of the computer with the external or peripheral equipment such as the keyboard, the monitor, the printer, phone modem, or the like. Typically, the electrical connectors are mounted at the back wall, or panel, of the computer such that an interconnection can be made without interfering with the internal works of the computer. A mating connector is then installed from the exterior of the computer panel to interconnect the internal electronics with the exterior equipment. Thus it is important for the electrical connector to project through the panel of the computer, or the like, for electrical interconnection thereto.

Electrical connectors exist which, when interconnected to discrete wires, are insertable through either the front or the rear of the panel. When the connector is inserted from the rear, the through hole is of course larger than the connector which could cause a radiation window. If the connector is installed from the front of the panel the discrete wires must be fed through the panel from the front, as the discrete wires must be terminated to the electrical connector prior to the mounting of the electrical connector. This prevents removal of the housing without also removing the interconnection of the discrete wires, thereby hindering the maintenance of the internals of the computer.

Electrical connectors also exist which are connectable to printed circuit boards, the connectors in turn being mountable to the interior of a panel. However, when the electrical connector is interconnected to a printed circuit board, the front interface portion can only be inserted through the rear of the panel, as the right angled portion of the connector with the printed circuit board attached can not be inserted into the interior of the panel through the front of the panel. The electrical connector is installed from the rear of the panel through a cutout which is formed in the panel. The access or cutout hole in the panel must be large enough to allow the front interface portion of the panel mounted connector to be inserted from the rear of the panel and through the panel, but it also must be large enough to allow the housing of the mating connector to project through the panel such that the housing of the mating connector abuts the housing of the panel mounted connector. If the system is to be shielded, the access hole prevents effective shielding of the electronic unit, as the panel itself is typically part of the shielding.

The printed circuit boards to which the electrical connectors are interconnected typically have a plurality of electronic packages, such as dual in-line packages (DIPs), electrically connected thereto. It is critical in the assembly of such an electrical connector to a printed circuit board that the terminals, which align with and project through the printed circuit board through holes, stay in alignment prior to their installation in the printed circuit board. Typically the connectors are robotically inserted onto the printed circuit board and then are run through a wave soldering bath to interconnect the connector to the traces on the board. If the connector terminals are not aligned with the through holes of the printed circuit board when the robot attempts to place the connector onto the board, the connector and possibly the printed circuit board are damaged.

One such connector which was designed for panel mounting which also keeps the terminals aligned with the printed circuit board through holes is disclosed in U.S. Pat. No. 4,469,387. The connector includes an upper and lower shroud member which encloses a comb member. The comb member is movable from a lower position to an upper position as the connector is lowered onto the printed circuit board. When the comb member is in its lowered position, the terminals are aligned within the channels of the combs which aligns the terminals with the through holes of the printed circuit board. Once the terminals mate with the through holes, the comb member is raised to an upper position where it is away from the circuit board and within the housing of the connector. Thus, the comb member's only function for the connector is to align the terminals with the printed circuit board, and the only function for the upper and lower shroud is to house the comb member. This arrangement, although it is technically feasible, is sometimes cost prohibitive due to the assembly cost of the component parts.

SUMMARY OF THE INVENTION

The instant invention relates to a panel mount electrical connector which is used for an I/O type interface, contains no moving parts, and requires no hardware for mounting of the connector to the panel, or for mounting the matable connector to the panel mount connector. The preferred embodiment of the connector includes a shielded portion which is mountable from the outside of a panel and a connector portion which is latchably attached to the shielded portion from the opposite side of the panel. The preferred embodiment of the connector is for right angled mounting to a printed circuit board.

The connector further includes a commoning means to ground the shielded portion to a ground trace on the printed circuit board. The commoning means includes a tab which is attached to the connector housing which projects through the printed circuit board and is soldered to the ground traces. When the shielded portion and connector are portion are attached to one another, the shielded portion has means projecting through the panel to resiliently common the shielded portion to the commoning means.

BRIEF DESCRIPTION OF THE DRAWINGS

FIG. 3A is a perspective view of a connector portion partially broken away.

FIG. 3B is a perspective view of the terminal.

DETAILED DESCRIPTION OF THE PREFERRED EMBODIMENT

Figure 1:
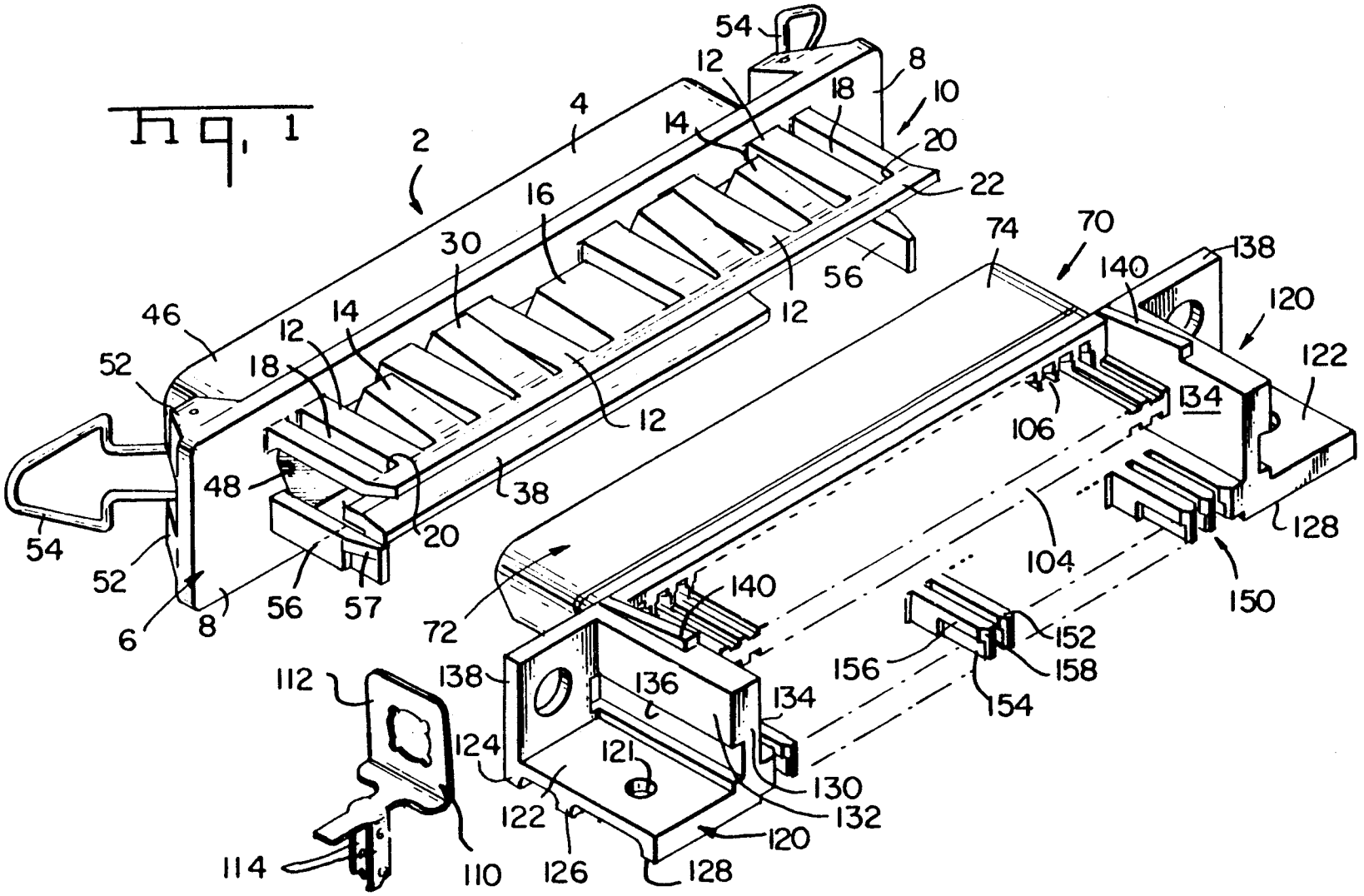
FIG. 1 is a perspective view of the shielded panel mount portion and the connector portion exploded away from each other.

Referring now to FIG. 1, the subject invention relates to a panel mounted electrical connector for interconnecting to a printed circuit board which is matable to a complementary connector of the type generally shown in U.S. Pat. No. 3,760,335. The panel to which the connector is mounted could be any type of wall which houses electronic components, although typically the connector will be used for mounting to a back panel of a personal computer or the like, providing electrical data I/O port for peripheral equipment such as keyboards, printers, and the like.

The panel mount portion 2 generally comprises a nose portion 4, a flange portion 6, an upper latch portion 10 and a lower latch portion 38. In the preferred embodiment of the instant invention the entire outer surface of the panel mounting portion 2 is plated with a metal for shielding purposes. The connector could however be used with an unplated version of the panel mount portion 2 if the shielding is not required. The nose portion 4 has a peripheral outer surface 46 which is profiled for receipt of an electrical connector of the type shown in U.S. Pat. No. 3,760,335. The upper latching extension 10 generally comprises plate members 12 extending from the flange wall 8 and extending outwardly therefrom, the plate members being interconnected by an inclined back rail 22. At each side edge of the plate members 12 are found notches 18 having a latch surface 20 thereon. Extending forwardly from the back rail 22 are two resilient latch members 14 and a center latch member 16. Also extending forwardly from the back rail 22 are commoning arms 30.

Figure 2:
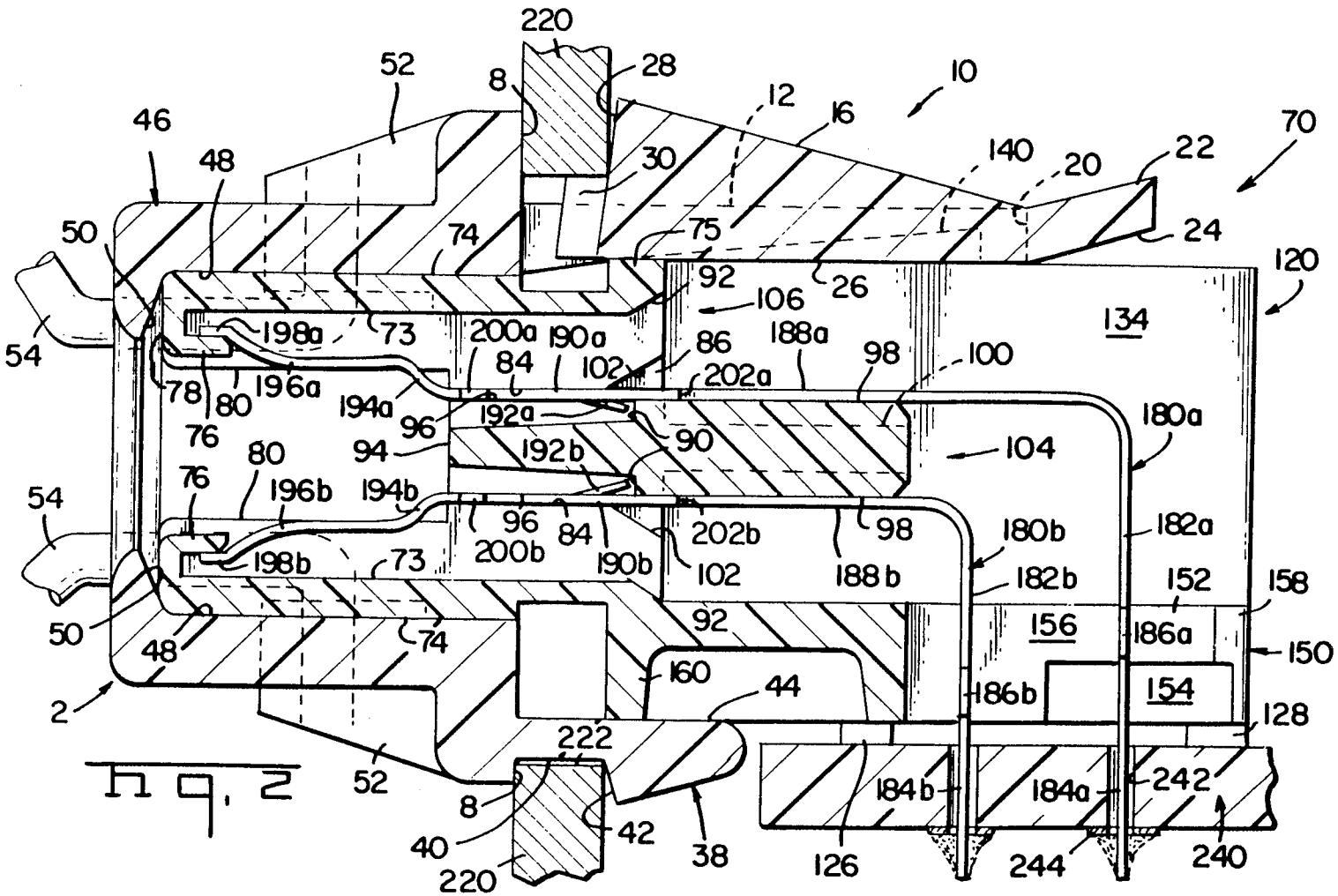
FIG. 2 is a cross-sectional view through lines 2—2 of FIG. 5.
Figures 7A, 7B:
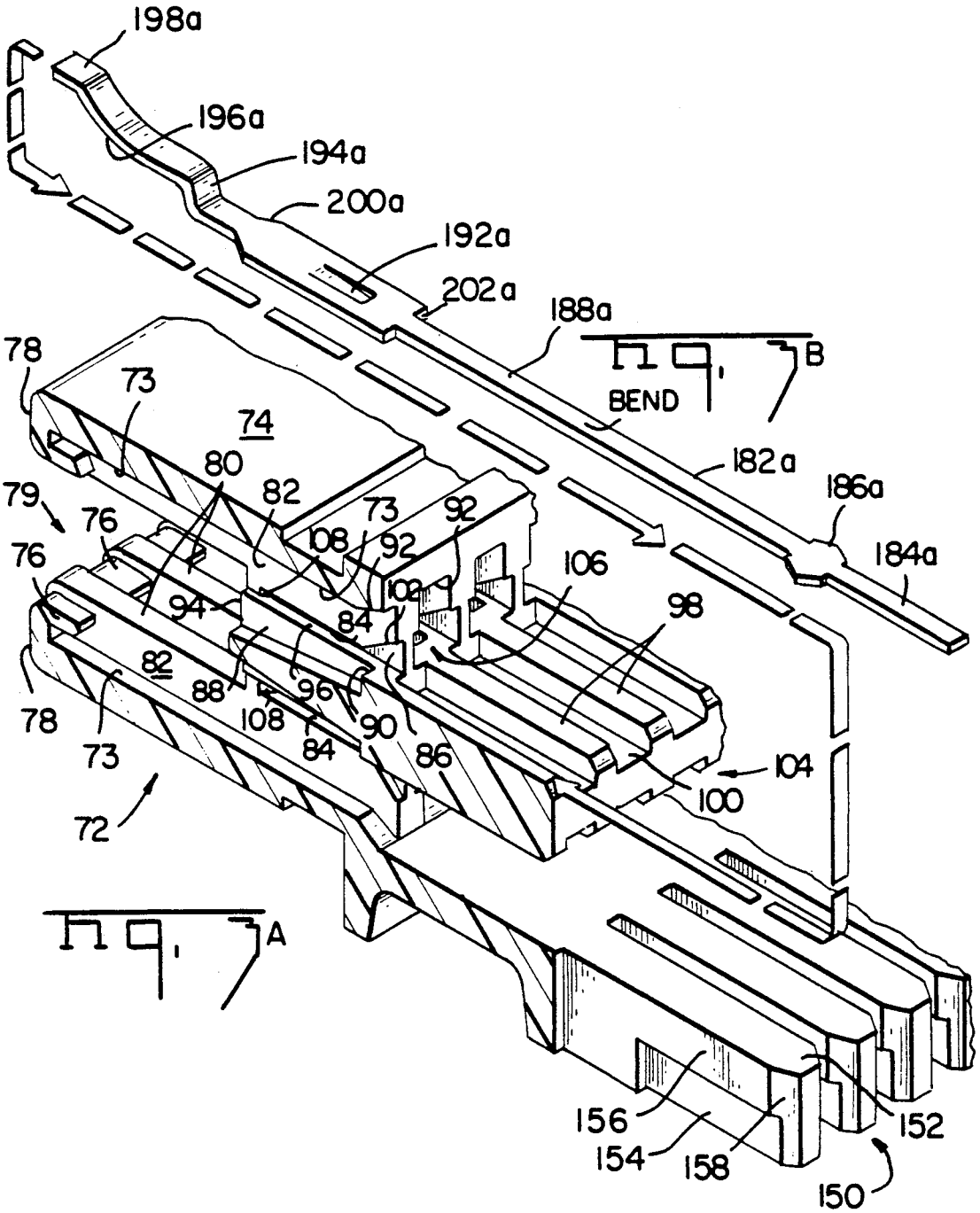

As best shown in FIG. 2, the lower latching extension 38 includes a channel 40 which is defined by the wall 8 of the flange 6 and by a shoulder 42. While still referring to FIG. 2, the panel mount portion 2 includes a connector receiving opening 48 which extends from the flange wall 8 and forwardly to a rearwardly facing shoulder 50. Referring again to FIG. 1, extending outwardly from the flange portion 6 and located on either side of the nose portion 46 are two boss members 52 for mounting the bail locks 54 thereto. Also extending from the mounting face 8 of the flange and on either side of the connector receiving opening 48 are two alignment arms 56.

Referring still to FIG. 1, the connector housing 70 generally comprises a forward nose portion 72, support feet 120 on either side of the housing 70, a terminal support portion 104 and a terminal locating portion 150. Referring now to FIG. 3A, the interior structure of the nose portion 72 of the connector housing 70 is shown in greater detail. The terminal support platform 104 extends rearwardly from the main body of the housing and includes terminal support surfaces 98, each support surface 98 being interrupted by a channel 100 which extends to the face of the central body portion. The terminal support platforms 98 extend forwardly into terminal receiving cavities 106 and are continuous and planar with support surface 96 which is within the terminal receiving cavity 106. The terminal receiving cavities 106 are defined by an upper lead in surface 92 continuous with an upper surface 73. The terminal receiving cavities 106 are further bounded by walls 82 on each side and by terminal receiving floor 96. A slot is formed on each side of the terminal receiving surface 96 which is defined by sidewalls 86, a lead in surface 102, an upper surface 84 and a stop surface 108.

The nose portion 72 of the connector housing extends forwardly from the central body portion of the connector housing and is bounded by an outer peripheral surface 74 and by an end surface 78. An opening 79 extends horizontally along the nose portion 72 providing an entry for the mating connector. Side walls 82 extend forwardly from the terminal receiving cavities 106 to the end surface 78. Each sidewall 82 is bounded at the top by an upper surface 80, which defines a terminal receiving area between the two sidewalls 82 and the floor 73. At the forward end of the nose portion 72 and in each of the channels defined by the sidewalls 82 and the floor 73 is a ledge 76.

The terminal locating section 150 extends from the central body portion of the housing 70 and generally includes a plurality of locater members 152. Each locater member 152 has a sidewall 156 which is parallel and opposed with a sidewall 156 of an adjacent locater member 152 to define therebetween a terminal receiving slot. Each locater member 152 further comprises a sidewall having a sidewall 154 which is parallel and opposed to another adjacent sidewall 154. The two different surfaces, 154 and 156, defines two different widths of slots, a wide slot defined between two parallel surface 154 and a narrower slot defined between two parallel and opposed surfaces 154. Each locater member 152 also includes a beveled lead in surface 158.

Referring again to FIG. 1, on each end of the connector housing portion 70 is included a mounting block portion 120. Mounting blocks 120 include walls 138 which are parallel to the flange surface 8, walls 122 which are parallel to a printed circuit board and walls 130 which are parallel and opposed to one another. Ribs 124, 126 and 128 extend from the bottom of wall 122. An alignment channel 136 extends along wall 130 and through wall 138. Locking members 140 are located on the top of wall 130. Retention tabs 110 are includeable on the mounting block portions 120 such that the plate 112 abuts wall 132 of the mounting block 120 and the tabs project through the holes 121 in the mounting blocks 120.

Referring now to FIG. 3B, the terminal is shown in greater detail. The terminals **180*a* and 180*b* are stamped and formed from a flat metal blank which is in a plane of the central sections 188*a* and 188*b*. Forward of the central sections 188*a* and 188*b* are wide sections 190*a* and 190*b* which have respective rear edges 202*a* and 202*b*, and forward beveled edges 200*a* and 200*b*. The terminals 180*a* and 180*b* further include radiused portions 194*a* and 194*b*, resilient contact portion 196*a* and 196*b* and end portion 198*a* and 198*b*. As initially stamped, the terminals generally conform to the plane of the original plate in the central sections 188*a* and 188*b*, then formed with the right angled portion 182*a* and 182*b* as shown in FIGS. 3A and 3B. The right angled portions 182*a* and 182*b* include barbs 186*a* and 186*b* and tail portions 184*a* and 184*b*** for interconnection to a printed circuit board.

To insert the terminals **180*a* and 180*b* within the terminal receiving cavities 106, an insertion tool or comb is utilized having teeth which can be forced against the edges 202***a* and 202*b*. For ease of assembly, the terminal support platform includes a plurality of channels 100 on either side of the terminal support platforms 98. This allows the comb to extend below the surface of the terminal support platform 98 and reside within the channels 100 assuring good contact force with the edges 202*a* and 202*b*. To install the terminals 180*a* and 180*b* within the housing 70, the respective terminals are installed above or below the terminal support platform 104, with the tip 198*a* or 198*b* of the terminal installed first within the terminal receiving cavity 106. To ensure that the terminal properly aligns with the terminal receiving cavity 106, beveled surface 92 is included at the front face of the terminal receiving cavity 106.

The lower ir inner terminals 180*b* are first inserted such that the central portions of the terminals 188*b* but the surfaces 98 of the terminal support platforms 104. With the comb tool pushing against edges 202*b*, the terminal 180*b* is projected forwardly into the nose portion 72 of the housing 70. The wide portions 190*b* of the terminals will reside in the slot defined by upper surface 84 and sidewalls 86 of the housing. To ensure that the wide portion 190*b* properly align with the slot, beveled surface 102 is included which is continuous with upper surface 84. With the terminals 188*b* vertically aligned with the lower terminal receiving cavity 106, the barbs 168*b* on the right angled portions 182*b* will be aligned with the wide slot defined between the two surfaces 154. The distance between the opposed surfaces 154 is larger than the width of the barbs 186*b* allowing the barbs 186*b* to float through a portion of the terminal locating slot 150. When the barbs contact the portions of the slots defined by the parallel surfaces 156, the barbs will skive into the plastic, as the slot is narrower than the barbs 186*b*. As the terminal float through the portion of the slot defined by the surfaces 156, the work required of the insertion tool, and the deformation of the barb as it skives into the plastic, are both kept to a minimum.

The terminals 180*b* are inserted into the terminal receiving cavities 106, and the terminal portions 182*b* into the slots, until the angled edges 200*b* of the terminals abut the respective angled surfaces 108. As so inserted, the forward tip 198*b* of the terminal inserted under the ledge 76 and adjacent to the upper surface 73, and the terminal will be locked in place with the lance 162*b* against the back surface 90 of the terminal receiving cavity.

With the lower row of terminals 180*b* installed, the upper row of terminals 180*a* can be installed in a similar manner to the lower terminals. The terminals 180*a* are installed into the terminal receiving cavities with the central portions 190*a* abutting the surface 98 of the terminal support platform 104. It should be noted that the barbs 186*a* are at a higher vertical location than the barbs 186*b*, barns 186*a* being located at the slots defined by the opposed surfaces 156. Continued forward movement of the terminals 180*a* into the cavities causes the barbs 186*a* to skive into the slots formed by the surfaces 156 and to locate the right angled portions 182*a* in a spaced apart and relationship with the right angled portions 182*b*.

By placing the barbs at 186*a* and 186*b* at different vertical locations, the barbs 186*a* do not have to "track" the previously inserted barbs 186*b*. When the barbs on right angled portions of terminals have to skive through the same vertical location in a terminal locating slot, the second terminal to be located is always looser than the first, as there is less interference between the barb and the plastic of the slot. In the instant case, the barbs 186*a* and 186*b* do not have to track themselves so that each right angled portion 182*a* and 182*b* is firmly located within respect to each other. The right angled portions of the terminals must remain on a precise spacing in order that the terminals properly match the spacing of the printed circuit board through holes.

The housing portion 70 is then mounted to the printed circuit board such that respective terminals 180*a* and 180*b* align with respective printed circuit board through holes 242, and such that respective retention tabs align with grounding traces 246 on the printed circuit board 240. The retention tabs will temporarily retain the connector to the printed circuit board until such time as the connector is soldered to the printed circuit board. When the connector is soldered to the printed circuit board, respective terminals are electrically connected to respective signal traces 244, and the retention tabs are electrically connected to the grounding traces 246.

Figure 4:
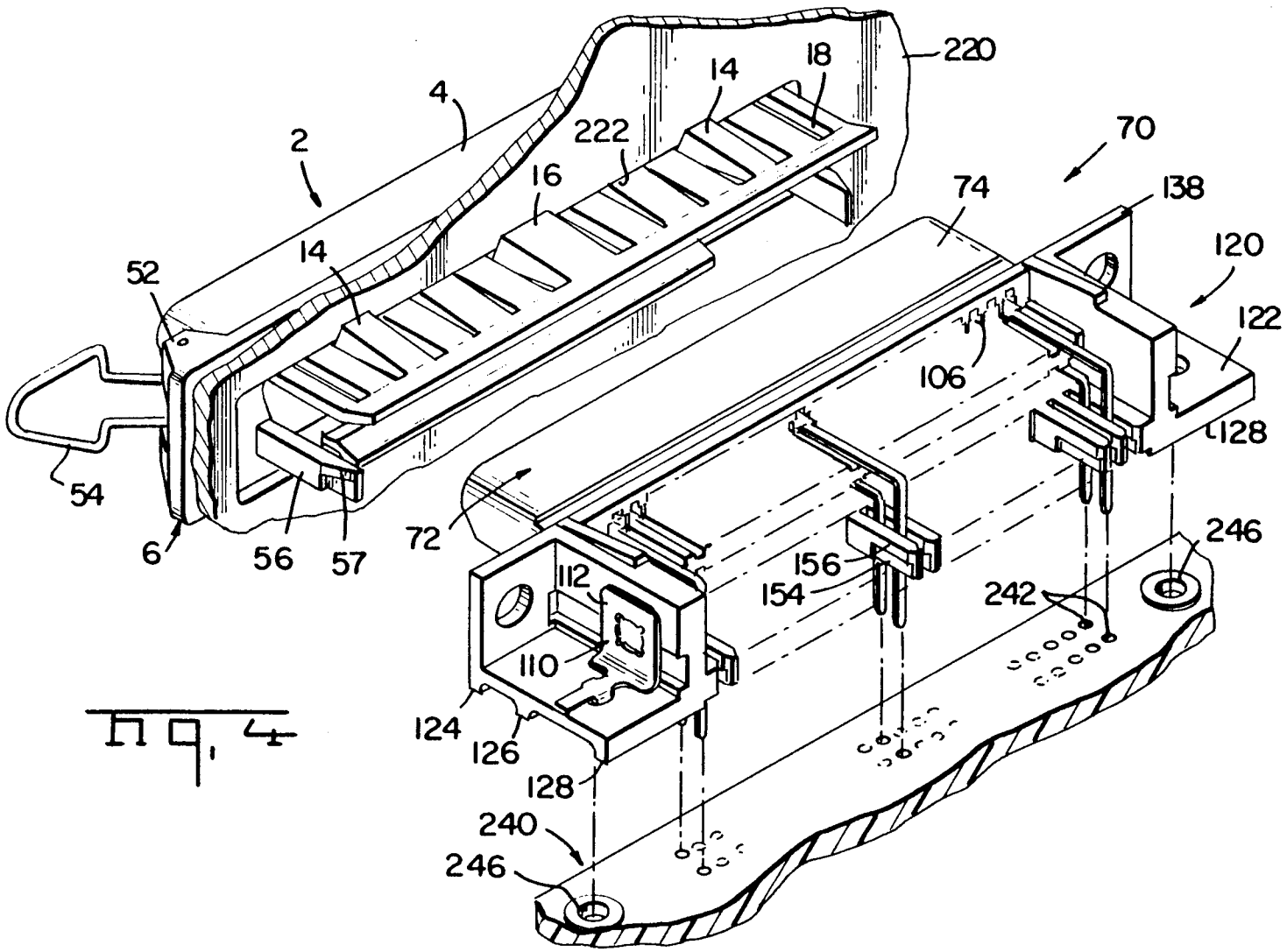
FIG. 4 is a perspective view showing the shielded panel mount portion attached to the panel and a printed circuit board exploded away from the connector portion.

The panel mount portion 2 is then insertable through an opening 222 of a panel 220 such that the lower portion of the panel 220 resides in the lower channel 40 and such that the resilient latches spring upwardly to latch the panel 22/ between the flange face 8 and the latch face 28, as shown in FIGS. 2 and 4. When the panel mount portion 2 is inserted through the opening 222 of the panel 220 as previously described, the resilient commoning arm 30 is biased upwardly to contact an edge of the panel 220 as best shown in FIG. 4. As mentioned earlier, the entire outer surface of the panel mount portion 2 is metal plated, which includes the commonin arms 30. The upward biasing of the commoning arms 30 provides a constant electrical connection between the forward shielded portion 2 and the metallic panel 220.

The connector housing 70 with the printed circuit board 240 attached thereto, is then insertable into the panel mount portion 2 to latchably connect the two components. The forward nose portion 72 is inserted into the opening 48 in the panel mount portion 2 to align the connector housing 70 with the panel mount portion 2, and alignment arms 56 which extend from the face 8 of the panel mount portion 2 locate within the channels 136 on wall 130 of the mounting block portions 120. With the arms 56 aligned within the channels 136, the connector housing 70 is insertable into the panel mount portion 2 until the end 78 of the nose portion 72 abust surface 50 of the panel mount portion 2. As previously mentioned, the alignment arms 56 are metal plated while the housing portion 70 is an insulative material such as a plastic. As the alignment arms project into the channels 136, the ramped portion 57 of the arms 56 locate behing the plate portion 112 of the retention tab 110. Continued insertion of the housing 70 biases the plated alignment arms 56 against the metal retention tabs 56, which ultimately electrically interconnects the shielded panel mount portion to the ground traces 246 on the printed circuit board.

Figure 5:
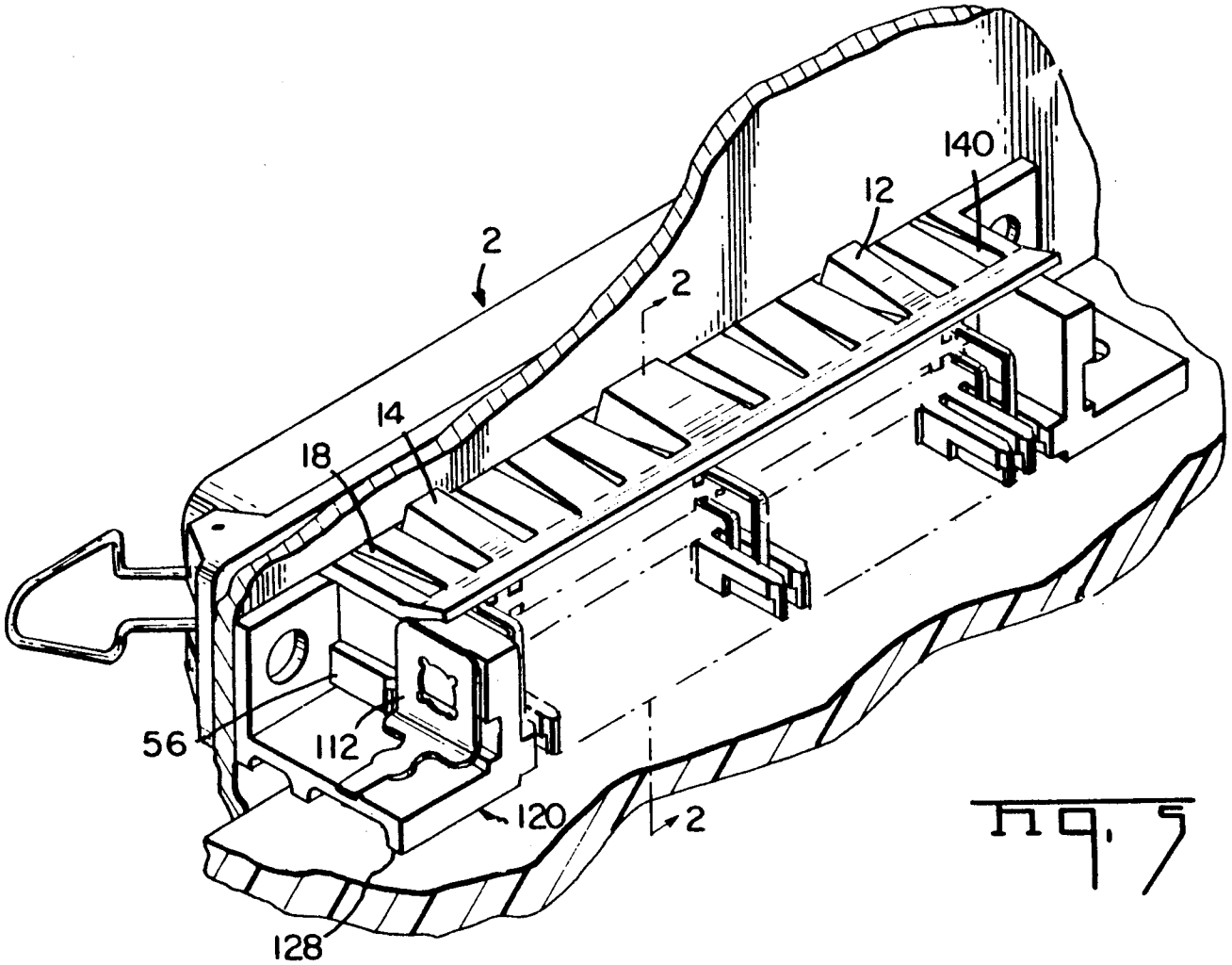
FIG. 5 is a perspective view of the assembled connector of the preferred embodiment.

The connecotr housing 70 is inserted until the latches 140 located on the top surface of the walls 130 are located within channels 18 on the upper extension 10 which locates the end surface of the latch 140 in an abutting relationship with the surface 20 of the channel 18 which locks the connector housing 70 to the panel mount portin 2. As best shown in FIG. 2, when the connector housing 70 is fully inserted within the panel mount portion 2, the standoff leg 160 located on the lower portion of the terminal loating extension 150 abuts surface 44 on the lower latching extension 38. Furthermore, a rib 75 located along an upper edge of the nose portion 72 abuts the lower portion of the resilient latches 14 and 16. As so located, the legs 160 and the rib 75 prevent the latches 38 and 14, 16 from disengaging from the panel. With the panel mount portion 2 and the connector housing 70 assembled as shown in FIG. 5, the connector is poised for receiving a matable connector such as that described in U.S. Pat. 3,760,335.

The preferred embodiment of the instant invention was described with reference to the Figures for illustrative purposes only and should be limiting to the claims which follow.

What is claimed:

1. An electrical connector for interconnecting a plurality of conductors and being mountable to a panel having an opening therethrough, the connector comprising:

a first connector portion profiled for mounting on a first side of a panel, the firt connector portion comprising means for latching the first connector portion to the panel, the first connector portion being profiled as a front mating face for receiving a matable electrical connector, and including a wall means mountable against the first side of the panel and a nose portion which extends away from the first side of the wall, the nose portion including an opening therethrough profiled for overlying the opening in the panel;

a second connector portion comrising an insulative housing and a plurality of terminals, the insulative housing and the first connector portion and the first connector portion together.

2. The electrical connector of claim 1 wherein terminals include resilient contact portions located within a forward portion of said housing portion.

3. The connector of claim 2 wherein the forward portion of said housing is profiled so as to extend through the opening in the panel and into the opening of the nose portion to dispose the resilient contact portions within the second connector portion through the panel and adjacent to the front mating face of the first connector portion.

4. The connector of claim 2 wherein the mounting means comprises upper and lower plate means extending perpendicularly from the wall means and profiled to project through the opening in the panel, the plate portions including latching members which bias against a second side of said panel.

5. The connecotr of claim 4 wherein the plate members are profiled in a spaced apart and parallel relation, the plate members being spaced to allow the forward portion of the housing to extend between the plate members.

6. An electrical connector of the type profiled for right angled mounting to a printed circuit board (240); the connector including an insulative housing (70) having a base means (120) for mounting on a printed circuit board and a face plate means perpendicularly disposed with respect to the base means, the housing including at least two rows of channels (100) extending therethrough for receiving a plurality of terminals (180*a*, 180*b*) and a terminal locating wall (150) which is disposed parallel to the base means and comprises a plurality of terminal receiving slots (154, 156), said connector having at least two rows of terminals (180*a*, 180*b*), a lower row of terminals (180*b*) having first portions (190*b*) extending into a lower row of channels (100) and a second portion (182*b*) which is perpendicular to the first portion and located in a terminal locating slot (154, 156) and an upper row of terminals (180*a*) first portions (190*a*) extending into an upper row of channels (100) and a second and perpendicular portion (182*a*) disposed in a terminal locating slot (154, 156), the terminals being laterally aligned such that the second portions (182*a*, 182*b*) of laterally aligned terminals are disposed in the same slots (154, 156), the connector being characterized in that:

the second portion (182*a*, 182*b*) of the terminals include barb means (186*a*, 186*b*) profiled to interferingly fit in the terminal locating slots (154, 156), the barb means on respective second portions of terminals located in the same terminal receiving slots being vertically offset from each other;

and in that the terminal locating wall includes a recessed are (154) defining a second larger width of slot which extends along a portion of the length of the slot to an outer end (158) of terminal locating wall, the recessed area (154) defining an area for the barb means (186*b*) on the lower row of terminals to freely travel upon insertion prior to interfering with the narrow portion of the slot.

7. The connector of claim 6 wherein the housing member includes tow rows of channels, an upper row and a lower row, each row extending along the length of the connector, each respective upper and lower channel being laterally aligned.

8. The connector of calim 7 wherein the housing member further comprises a terminal support floor extending from a rear wall of the housing between the two rows of channels.

9. The connector of claim 8 wherein an upper surface of the terminal support floor is continuous with a floor of the channel, and a lower surface of the terminal support floor is continuous with a top surface of the lower row of channels.

10. The connector of claim 9 wherein the upper and lower surface include open channels which extend outwardly from the rear wall of the housing to an end of the terminal support floor, and are located on alternate sides of the terminal receiving channels.

11. The connector of claim 10 wherein the terminals include a wide section along the portion which lies along the terminal support floor, having edges which overlie the open channels, whereby an insertion tool can be placed against the terminals and extend into the open channels to force the terminals into place.

12. A shielded electrical connector for mounting on a panel and for electrical interconnection to a printed circuit board, the electrical connector comprising:

forward shielded portion having a wall portion and a nose portion extending from an outer surface thereof defining a front mating face, the wall portion further comprising an inner surface which is mountable substantially flushly to an outside surface of a panel, the forward shielded portion further comprising an opening means therethrough from the inner surface extending forwardly towards the front mating face, the forward shield portion including latch means extending from the inner surface of the wall means and profiled to extend through an opening in a panel to latchably attach the forward shield portion to the panel;

an insulative housing means have a plurality of terminals mounted therein, each termnal having a forward portion disposed in a forward portion of the housing and a right angled portion which extends below a mounting portion of the housing for interconnection to printed circuit board through holes, the forward portion of the housing being profiled for insertion into the shielded portion from the inside surface of the panel to dispose the terminals adjacent the front mating face, the forward shielded portion and the housing portion cooperatively profiled to latchably connect the housing to the forward shielded portion.

13. The electrical connector of claim 12 wherein the forward shielded portion further comprises means to resiliently bias and common the shielded portion to the panel.

14. The electrical connector of calim 12 wherein the latch means comprise first and second ledges extending from the inner surface of the wall means having respective first and second latches located thereon, the first and second ledges being profiled to extend through the opening in the panel to connect the forward shielded portion to the panel from the rear of the panel.

15. The electrical connector 14 wherein one of the latches includes a resilient member which extends forwardly from the ledge to define a latching surface spaced from the inner surface of the wall means to between the panel between the inner surface and the latching surface.

16. The electrical connector of claim 14 wherein the one of said ledges include notches and the housing includes a locking member profiled to be received in the notches, to lock the shielded portion and the housing portion together.

* * * * *